United States Patent [19]

Martin

[11] 3,996,053

[45] Dec. 7, 1976

[54] PHOTOSENSITIVE COMPOSITION CONTAINING A MIXTURE OF CADMIUM IODIDE AND CUPROUS IODIDE

[75] Inventor: Thomas William Martin, Rochester, N.Y.

[73] Assignee: Eastman Kodak Company, Rochester, N.Y.

[22] Filed: July 21, 1975

[21] Appl. No.: 597,782

[52] U.S. Cl. ..... 96/48 R; 96/48 QP; 96/119 PQ; 96/88

[51] Int. Cl.[2] ..... G03C 1/00; G03C 5/24

[58] Field of Search ..... 96/88, 48 R, 48 QP, 96/119 QP, 1.5, 108

[56] References Cited

UNITED STATES PATENTS

| | | | |
|---|---|---|---|
| 3,109,737 | 11/1963 | Scott | 96/108 |
| 3,143,419 | 8/1964 | Gilman | 96/119 QP |
| 3,420,669 | 1/1969 | Sutherns et al. | 96/108 |
| 3,436,221 | 4/1969 | Sprung | 96/108 |
| 3,573,305 | 3/1971 | Allentoff et al. | 96/108 |
| 3,707,372 | 12/1972 | Hallman et al. | 96/1.5 |

*Primary Examiner*—Won H. Louie, Jr.

*Attorney, Agent, or Firm*—A. H. Rosenstein

[57] ABSTRACT

A photosensitive composition comprising a mixture of cadmium iodide and cuprous iodide is useful in photographic elements. The elements are imagewise exposed to radiation and conventionally developed to form an image.

17 Claims, No Drawings

PHOTOSENSITIVE COMPOSITION CONTAINING A MIXTURE OF CADMIUM IODIDE AND CUPROUS IODIDE

This invention relates to photography and more particularly to a photosensitive material comprising a mixture of cadmium iodide and cuprous iodide. Images in a radiation sensitive element containing the mixture are formed by imagewise exposing the photosensitive mixture on a support to near ultraviolet light or the visible region of the spectrum and developing the image. The process does not require the presence of a silver halide to provide a developed image using a reasonably short exposure time.

Silver halide emulsions which can be imagewise exposed to visible and near ultraviolet light and developed by chemical developers or which can print out directly are well known in the art. In U.S. Pat. Nos. 3,420,669 and 3,573,055 silver halide emulsions containing small amounts of other metal halides as dopants to enhance the properties of the silver halide are disclosed. The silver halide is the photosensitive material.

The use of photographic silver halide to achieve high contrast films, however, has disadvantages. The high expense and shortage of silver has resulted in a continuing search for substitutes. Thus far, no material has been found to provide the high contrast provided by photographic silver halide within reasonable exposure times.

The use of non-silver salts to produce visible images is known, as described, for example, in U.S. Pat. No. 3,707,372. This patent discloses a two layer process wherein exposure generates a product in the second layer that reacts with the metallic image in the first layer. The image is formed in the first layer. This process, however, does not produce an image that can be developed. This is a unit quantum process and is inherently slow requiring long exposure time.

An ideal photographic system requires only a small amount of exposure from the particular radiation source being used to record the desired information. Thus, high speed photographic systems are generally characterized by use of a catalytic image amplification step.

Therefore, it is an object of this invention to provide a non-silver photosensitive material which can be exposed to form an image that is developed to form a visible, stable image with short exposure times.

It has been discovered that a photosensitive material comprising a mixture of cadmium iodide and cuprous iodide in a binder for the mixture can provide developable nuclei upon imagewise exposure of the material to near actinic light or visible light. If desired, the nuclei can provide a print-out image.

The use of the mixture of cadmium iodide and cuprous iodide in a photosensitive composition to be chemically wet developed is particularly surprising since (a) cuprous iodide alone is not photosensitive because essentially no copper metal is formed on exposure and (b) cadmium iodide used alone cannot be exposed to give a developable latent image.

The photosensitive composition comprises a mixture of cadmium iodide and cuprous iodide in a binder for the mixture.

The mixture comprises both cadmium iodide and cuprous iodide, preferably having a cadmium iodide to cuprous iodide molar ratio of from about 2:1 to about 1:2. More preferably, the mixture is equimolar.

The binder for the mixture can be either water soluble such as polyvinyl alcohol or water insoluble such as a thermoplastic polycarbonate condensation product of a bisphenol and phosgene. Other binders useful herein include styrene, polystyrene, styrene-butadiene, polyvinyl acetate, polyvinyl butyral, polyvinyl formal, polyvinyl chloride and the like. In general, any binder which is not coagulated by either the cadmium iodide or cuprous iodide is useful.

The weight ratio of mixture to binder can vary widely but the preferred weight ratio is 3:1 to 9:1. It is found that coatings prepared from dispersions with mixture to binder weight ratios of less than 5:1 are less photosensitive than those having a weight ratio of greater than 5:1. A particularly preferred dispersion contains the mixture to binder weight ratio of about 7:1.

If a water insoluble binder is used, the mixture and binder can be used in a solvent dispersion. Useful solvents herein include dichloromethane, dichloroethane, toluene, acetone and the like. The binder can typically be present as a 3 to 20% solution in the solvent. In the preferred embodiment, however, the binder and mixture is dispersed in water.

The photosensitive composition can contain addenda known to be useful in silver halide coating compositions such as coating aids, hardeners, plasticizers and the like.

Preferred addenda include halogen acceptors to combine with the iodine produced in the photolytic reaction and prevent if from recombining with the metal nuclei formed. Useful halogen acceptors include acetone semicarbazone, $Na_2SO_3$, $NaNO_2$ and the like. The halogen acceptor is preferably present in an amount of from 3 to about 8% by weight of photosensitive mixture.

A hardener for the binder can also be incorporated in the composition. Useful hardeners include formaldehyde, silicic acid, amino-aldehyde pre condensates and the like. The hardeners can comprise from about 3 to about 10 weight percent of the composition.

The photosensitive composition can be prepared by milling the cadmium iodide and cuprous iodide mixture in a solution of the binder, with halogen acceptors and hardeners if desired. Alternatively, the cadmium iodide and cuprous iodide can be ground into a powder and added to the binder. The mixture is generally milled from between 4 and 60 hours. The grain size of the powdered mixture generally ranges from about $0.5\mu$ to about $5\mu$.

The photosensitive compositions can also be chemically or spectrally sensitized. Chemical sensitization can be obtained, for example, by adding a sensitizer such as $Na_2S_2O_3.5H_2O$ (for example 0.1 gram) or $Na_2S_2O_4$ (for example 0.1 gram) dissolved in 10 ml. of water to 40 gms. of the unsensitized dispersion and heating and stirring at 75° C for about 30 minutes. Spectral sensitization can be achieved, for example, by adding a spectral sensitizing dye to the photosensitive composition such as by adding 0.01 gram of sensitizing dye such as 0.01 gram of Erythrosin B dye (Eastman Kodak Co.) to 40 grams of unsensitized dispersion and stirring for about 30 minutes. Spectral sensitization of the photographic composition allows the composition to have sensitivity in the near UV and the full visible spectrum. The chemical sensitizers can generally comprise from about 0.001 to about 0.1 weight percent of the photosensitive composition and the spectral sensitizers can generally comprise from about 0.00025 to about 0.025 weight percent of the photosensitive composition.

The photosensitive composition can be applied to any substrate typically used for photographic elements. Support materials used herein are subject to wide variation. Glass can be employed as can be paper or metal such as aluminum, copper- zinc and tin. Conventional film supports such as cellulose acetate, cellulose nitrate, cellulose acetate butyrate, poly(ethylene terephthalate), polystyrene mylar and cermet coated supports are also used. Generally, the support should contain from about 500 to about 5000 mg/0.096 $m^2$ of photosensitive composition.

The elements can be formed by coating the support with the photosensitive composition and drying. A particularly preferred method of applying the photosensitive composition is to filter the dispersion through a 100 mesh nylon screen and coat on the support with a 0.02 inch coating knife and drying and heating at 100° to 120° C for 5 to 10 minutes to harden.

The coatings are quite stable and retain their light sensitivity for 2 months or longer without significant change.

The elements are typically exposed through a pattern of light providing a latent image corresponding to the exposed or unexposed areas. The mixtures are sensitive to ultraviolet and visible light. Sources of light include sunlight as well as high vapor mercury lamps, carbon arc lamps and other conventional light sources. It is noted that these non-silver photographic elements can be exposed at the lower end of the camera speed range (less than 10 ergs/$cm^2$).

The latent image in the exposed elements can be developed into a desired metal image, typically a visible image, by chemical development.

Although the elements are preferably developed chemically, the elements can also print out to acceptable density.

An amplified image is obtained by chemical development. The chemical development is carried out by treating the element, for example, with a developer composition comprising an aqueous solution of $Na_2S_2O_4$ reducing agent. The preferred composition comprises a 5 to 10% by weight aqueous solution of $Na_2S_2O_4$. The developer can also comprise a fog inhibitor such as KI or thiourea.

The image can, if desired, be fixed to prevent subsequent print out of unexposed areas. Fixing can be carried out, for example, by immersing the developed coating in a 20–30% aqueous solution of potassium thiocyanate.

The process of this invention can be useful in forming elements for use as printed circuits, photoresists, and have good ink-water differentiation and can be used as a photosensitive printing plate.

Once the image is developed, it can be amplified by physically developing in a metal salt-containing bath such as in a copper physical development bath and the metal such as copper can be deposited and built up on the exposed portions of the element only. This is generally useful in forming printed circuits.

The following examples are included for a further understanding of the invention.

EXAMPLE 1

14.3 g (0.075 mole) CuI, 27.5 g (0.075 mole) $CdI_2$, 3.0 g acetone semicarbazone (halogen acceptor), 18 ml Formalin (hardener), 120 g polyvinyl alcohol solution (5% solids) and 30 g 0.5 inch dia. glass balls were placed in a brown glass jar and milled on a ball mill for about 16 hours.

The resulting dispersion was coated at a 20 mil wet thickness on a gelatin subbed polyethylene terephthalate support and dried in a dark box for about 16 hours. The coating was then heated at about 100° to 120° C for 10 minutes to harden.

A sample of the finished coating was given a sensitometric exposure to 380 nm light.

The sample was then immersed in a developer at room temperature consisting of 200 ml $H_2O$ and 15 g $Na_2S_2O_4$ for about 5 to 7 minutes. It was then rinsed in $H_2O$ for about 1 minute.

The sample was then immersed in a fixing solution consisting of 300 ml $H_2O$ and 60 g KSCN for 5 minutes, washed with $H_2O$ for about 3 to 5 minutes and dried.

The following sensitometric results obtained are described in Table 1.

Table 1

| Exposure Time | Time Elapsed Between Exposure & Development | D max Image | D min Fog |
|---|---|---|---|
| 5 seconds | 1 second | 1.19 | 0.10 |
| 5 seconds | 4.5 hours | 1.15 | 0.10 |
| 5 seconds | 24 hours | 1.17 | 0.11 |

It is thus seen that the latent image stability is excellent.

EXAMPLE 2

4.76 g (0.025 mole) CuI and 9.16 g (0.025 mole) $CdI_2$ were mixed by grinding for about 60 minutes on an automatic grinder in a mullite mortar and pestle. The mixture was then heated at 300° C for about 60 minutes to increase the particle size and then placed in a brown glass jar with 30 g ½ inch glass balls and 30 g of Lexan solution (7% Lexan dissolved in a mixture of 50% dichloroethane - 50% dichloromethane). The mixture was milled as in Example 1.

The resulting dispersion was coated at a 0.010 inch wet thickness on Baryta paper and dried as in Example 1.

Samples of the coating were exposed to 380 nm light at various intensities for various lengths of time. A print out image of reasonable density was achieved.

EXAMPLE 3

A sample of coating prepared in Example 1 was exposed through a test negative with 366 nm light for 5 seconds (approximately $10^5$ ergs/$cm^2$).

The sample was developed as in Example 1, washed, and then immersed in a solution consisting of 300 ml $H_2O$ and 200 g KI for a period of about 20 to 30 minutes (until excess undeveloped material was removed from the coating).

The resulting transparency was washed in $H_2O$ for 5 minutes and dried. It had an image transmission density of 0.80.

EXAMPLE 4

2.88 g (0.0125 mole) CuI, 9.16 g (0.025 mole) $CdI_2$, 6 ml Formalin, 40 g polyvinyl alcohol solution and 15 g 0.5 inch dia. glass balls were placed in a brown glass jar and milled, coated, dried and hardened as in Example 1.

A sample of coating was exposed through a test negative with 366 nm light for 5 seconds (approximately $10^5$ ergs/$cm^2$).

The sample was developed, fixed, washed and dried as in Example 1. The resulting image reflection density was 0.65.

EXAMPLE 5

4.76 g (0.025 mole) CuI, 4.58 g (0.0125 mole) $CdI_2$, 6 ml Formalin, 40 g polyvinyl alcohol solution and 15 g 0.5 inch dia. glass balls were placed in a brown glass jar and milled, coated, dried and hardened as in Example 1.

A sample of coating was exposed through a test negative with 366nm light for 5 seconds (approximately $10^5$ ergs/cm$^2$).

The sample was developed, fixed, washed and dried as in Example 1. The resulting image reflection density was 0.75.

EXAMPLE 6

40 ml of the dispersion prepared in Example 1 was mixed with 1 ml of an aqueous 0.05% solution of Erythrosin B and coated at a 0.020 inch wet thickness on gelatin subbed polyethylene terephthalate, dried and hardened as in Example 1.

A sample of the resulting coating was given sensitometric exposure to white light.

The sample was developed, fixed, washed and dried as in Example 1. A good image was obtained.

EXAMPLE 7

9.16 g (0.025 mole) CdI, 4.76 g (0.025 mole) CuI, 1.0 g acetone semicarbazone, 0.001 g $Na_2S_2O_3.5H_2O$, 0.0004 g KSCN, 6 ml Formalin, 40 g polyvinyl alcohol solution and 15 g 0.5 inch dia. glass balls were placed in a brown glass jar and milled as in Example 1.

20 ml of the resulting dispersion was heated with stirring at about 70° C for 10 minutes. The dispersion was then filtered through 100 mesh nylon screen and coated, dried and hardened as in Example 1.

A sample of finished coating was given a sensitometric exposure to 380nm light.

The sample was then developed, fixed, washed and dried as in Example 1.

A good image was obtained.

EXAMPLE 8

Example 7 was repeated except 0.15 g $Na_2S_2O_4$ was used as sensitizer. A sensitivity increase of 1.0 log E units was obtained over the sensitivity of unsensitized materials.

EXAMPLE 9

This is a comparative example. A series of metal halide mixtures were prepared and tested for photographic activity. The compositions were prepared as in Example 1 wherein the following mixtures were prepared in equimolar amounts:

Example A — $ZnI_2$:CuI
Example B — $CdI_2$:CuCl
Example C — $PbI_2$:CuI and
Example D — $CdBr_2$:CuI.

The same exposure, development and fixing steps described in Example 1 were carried out with each composition. None of these compositions produced a developed image. After an exposure 200 times longer than that used in Example 1 and similar development, the compositions of Examples A, B and C still did not develop an image. The composition of Example D developed an image but considerable fog formation was obtained.

Although the invention has been described in considerable detail with reference to certain preferred embodiments thereof, it will be understood that variations and modifications can be affected without departing from the spirit and scope of the invention as described hereinabove.

We claim:

1. A photosensitive composition consisting essentially of a mixture of cadmium iodide and cuprous iodide in a binder for the mixture.

2. The composition of claim 1 wherein the molar ratio of cadmium iodide to cuprous iodide is from about 2:1 to about 1:2.

3. The composition of claim 1 wherein the mixture to binder weight ratio is from about 3:1 to about 9:1.

4. The composition of claim 1 wherein the binder is selected from the group consisting of styrene, styrenebutadiene copolymer, polystyrene and polyvinyl alcohol.

5. The composition of claim 1 also containing a spectral sensitizer.

6. A composition of claim 1 including a solvent for the binder.

7. A photographic element comprising a support having thereon a mixture consisting essentially of cadmium iodide and cuprous iodide in a binder for the mixture.

8. The photographic element of claim 7 wherein the molar ratio of cadmium iodide to cuprous iodide is from about 2:1 to about 1:2.

9. The photographic element of claim 7 wherein the mixture to binder weight ratio is from about 3:1 to about 9:1.

10. The photographic element of claim 7 wherein the binder is selected from the group consisting of styrene, styrenebutadiene copolymer, polystyrene and polyvinyl alcohol.

11. In the process comprising imagewise exposing an element comprising a support having thereon a non-silver photosensitive composition to irradiation and subsequently developing an image by contacting the exposed element with a chemical developer containing a reducing agent for cadmium iodide and cuprous iodide, the improvement comprising using as the non-silver photosensitive composition, a mixture consisting essentially of cadmium iodide and cuprous iodide in a binder therefor.

12. The process of claim 11 wherein the molar ratio of cadmium iodide to cuprous iodide is from about 2:1 to about 1:2.

13. The process of claim 11 wherein the mixture to binder weight is from about 3:1 to about 9:1.

14. The process of claim 11 wherein the developer comprises $Na_2S_2O_4$ as a reducing agent.

15. The process of claim 14 wherein the developer also comprises thiourea.

16. The process of claim 14 wherein the developer also comprises potassium iodide.

17. The process of claim 11 wherein the developed image is fixed with an aqueous solution of potassium thiocyanate.

* * * * *